US008424325B2

(12) United States Patent
Choi et al.

(10) Patent No.: US 8,424,325 B2
(45) Date of Patent: Apr. 23, 2013

(54) AIR CONDITIONER

(75) Inventors: In Ho Choi, Seoul (KR); Jong Chan Park, Seoul (KR); Han Lim Choi, Seoul (KR); Dong Whan Choi, Seoul (KR); Nam Sik Yim, Seoul (KR)

(73) Assignee: LG Electronics Inc., Seoul (KR)

( * ) Notice: Subject to any disclaimer, the term of this patent is extended or adjusted under 35 U.S.C. 154(b) by 751 days.

(21) Appl. No.: 12/640,817

(22) Filed: Dec. 17, 2009

(65) Prior Publication Data

US 2010/0175399 A1 Jul. 15, 2010

(30) Foreign Application Priority Data

Jan. 9, 2009 (KR) ..... 10-2009-0001983

(51) Int. Cl.
*F25D 17/04* (2006.01)
*F24F 11/00* (2006.01)
*G05B 21/00* (2006.01)

(52) U.S. Cl.
USPC ..... 62/186; 62/408; 165/237; 700/278

(58) Field of Classification Search ..... 62/186, 62/132, 259.1, 408; 165/237; 700/276, 277, 700/278; 494/292
See application file for complete search history.

(56) References Cited

U.S. PATENT DOCUMENTS

| | | | |
|---|---|---|---|
| 7,185,504 | B2 | 3/2007 | Kasai |
| 2006/0168862 | A1 | 8/2006 | Kim |

FOREIGN PATENT DOCUMENTS

| | | | |
|---|---|---|---|
| JP | 07-151370 | A | 6/1995 |
| JP | 2007-322118 | A | 12/2007 |
| JP | 2009-002618 | A | 1/2009 |
| KR | 10-0295964 | B1 | 10/2001 |
| KR | 10-076178 | | 9/2007 |

OTHER PUBLICATIONS

Internatioal Search Report issued in Application No. PCT/KR2009/005400, mailed Mar. 2, 2010, 3 pages.

*Primary Examiner* — Chen Wen Jiang
(74) *Attorney, Agent, or Firm* — Fish & Richardson P.C.

(57) ABSTRACT

Disclosed is an air conditioner includes a cabinet that is configured to mount on an indoor ceiling. The air conditioner also include a front panel that is coupled to the cabinet and having an air inlet and outlet. The air conditioner further include a suction panel that is coupled to the front panel and configured to move between an open positione in which air is able to circulate through the air conditioner and a closed position in which air is blocked from circulating through the air conditioner. The air conditioner further include a sensor unit that is mounted on the suction panel, that is configured to move together with the suction panel and that is configured to detect a position of a person in the indoor place. In addition, the air conditioner also include a controller adjusting a direction of air flow from the outlet based on the deteded position of the person.

14 Claims, 2 Drawing Sheets

AIR CONDITIONER

CROSS-REFERENCE TO RELATED APPLICATIONS

The present application claims the benefits of priority to Korean Patent Application No. 10-2009-0001983 (filed on Jan. 9, 2009), which is herein incorporated by reference in its entirety.

FIELD

The present invention relates to an air conditioner.

BACKGROUND

Generally, an air conditioner, which is an apparatus for heating or cooling air using a refrigerant cycle, is sorted into a household air conditioner and an industrial air conditioner.

The household air conditioner may include a separate type air conditioner in that an indoor unit and an outdoor unit are separated and an integrated type air conditioner in that an indoor unit and an outdoor unit are combined. The indoor unit of the separate type air condition can be sorted into a wall mounted type indoor unit that is mounted on a wall, a standing type indoor unit that stands on a bottom part, and a ceiling type (or cassette type) indoor unit that is mounted on a ceiling.

A structure where an Infra-Red (IR) sensor or a Pyroelectric Infra-Red (PIR) sensor, etc., is mounted on one side of the indoor to concentratedly supply cool air or warm air to a spot of the space in which indoor resident is positioned has been disclosed.

SUMMARY

In one aspect, an air conditioner includes a cabinet configured to mount on an indoor ceiling. The air conditioner also includes a front panel coupled to the cabinet and having an air inlet and outlet. The air conditioner further includes a suction panel coupled to the front panel and configured to move between an open positione in which air is able to circulate through the air conditioner and a closed position in which air is blocked from circulating through the air conditioner. The air conditioner further includes a sensor unit that is mounted on the suction panel, that is configured to move together with the suction panel and that is configured to detect a position of a person in the indoor place. In addition, a controller configured to adjust a direction of air flow from the outlet based on the deteded position of the person.

Implementations may include one or more of the following features. For example, the sensor unit is mounted on an edge part of the suction panel. The sensor unit is mounted on a central part of the suction panel.

In some implementations, The sensor unit includes a sensing element configured to rotate forward or reversely in response to a driving signal generated by a driving motor. The sensor unit also includes a sensor cover configured to cover the sensing element. The sensor cover is defined in a cylindrical shape or its bottom part has a convexly curved shape. The sensor cover is defined as an opaque body or material.

In some examples, the sensor unit further detects movement of the person in the indoor. The sensor unit further detects heat radiated from the person and generates a control signal to control a temperature of air output by the air conditioner based on comparing the detected the radient heat with a reference value. An amount of rotation of a discharge vane is adjusted by the controller.

In another aspect, an air conditioner includes a cabinet configured to mount on an indoor ceiling. The air conditioner also includes a front panel coupled to the cabinet. The air conditioner further includes a suction panel coupled to the front panel and configured to move between an open position in which air is able to circulate through the air conditioner and a closed position in which air is blocked from circulating through the air conditioner. The air conditioner further includes a sensor unit mounted on the suction panel configured to move together with the suction panel, configured to detect a position of a person and configured to start the detection in connection with movement of the suction panel during an initial stage of the air conditioner. In addition, a controller configured to adjust a direction of air flow from the outlet based on the deteded position of the person.

Implementations may include one or more of the following features. For example, the sensor unit includes a sensing element configured to rotate forward or reversely in response to a driving signal generated by a driving motor. The sensing unit also includes a sensor cover configured to cover the sensing element.

In some implementations, the sensor cover is defined in a cylindrical shape or its bottom part has a convexly curved shape. The sensor cover is defined as an opaque body or material. The sensor unit is configured to start the detection after the movement of the suction panel is completed.

In yet another aspect, an air conditioner includes a cabinet configured to mount on an indoor ceiling. The air conditioner also includes a front panel coupled to the cabinet. The air conditioner further includes a suction panel coupled to the front panel configured to move between an open position in which air is able to circulate through the air conditioner and a closed position in which air is blocked from circulating through the air conditioner. The air conditioner further includes a sensor unit that is mounted on the suction panel, that is configured to move together with the suction panel and that is configured to detect a position of a person in the indoor place, wherein the detection is started indepentantly from the movement of the suction panel during an initial stage of the air conditioner. In addition, a controller configured to adjust a direction of air flow from the outlet based on the deteded position of the person.

Implementations may include one or more of the following features. For example, the sensor unit includes a sensing element configured to rotate forward or reversely in response to a driving signal generated by a driving motor. the sensor unit also includes a sensor cover configured to cover the sensing element.

In some implementations, the sensor cover is defined in a cylindrical shape or its bottom part has a convexly curved shape. The sensor cover is defined as an opaque body or material. The sensor unit starts the detection in response to power on of the air conditioner.

In yet another aspect, an air conditioner includes a cabinet configured to mount on an indoor place. The air conditioner also includes a front panel coupled to the cabinet. The air conditioner further includes a suction panel coupled to the front panel and configured to move between an open positions in which air is able to circulate through the air conditioner and a closed position in which air is blocked from circulating through the air conditioner. The air conditioner further includes a sensor unit mounted on the suction panel and configured to detect a position of a person or moving object when the air conditioner is in a power off state or a sleeping mode. In addition, the air conditioner includes a controller configured to control the air conditioner to power on from the power off state or the sleeping mode in response to the deteded position.

Implementations may include one or more of the following features. For example, the sensor unit is configured to start the detection in connection with the movement of the suction panel during an initial stage of the air conditioner. The sensor unit configured to start the detection independently from the movement of the suction panel during an initial stage of the air conditioner.

In yet another aspect, an air conditioner includes a front panel coupled to the cabinet. The air conditioner also includes a suction panel coupled to the front panel and configured to move between an open positions in which air is able to circulate through the air conditioner and a closed position in which air is blocked from circulating through the air conditioner. The air conditioner further includes a sensor unit mounted on the suction panel and configured to detect a position of a person or moving object when the air conditioner is in a power off state or a sleeping mode. In addition, a controller configured to control the air conditioner t to turn off the power in response to determining that no person or moving object is detected.

In yet another aspect, an air conditioner includes a front panel coupled to the cabinet. The air conditioner also includes a suction panel coupled to the front panel and configured to move between an open positions in which air is able to circulate through the air conditioner and a closed position in which air is blocked from circulating through the air conditioner. The air conditioner further includes a sensor unit mounted on the suction panel and configured to detect a position of a person or moving object when the air conditioner is in a power off state or a sleeping mode. In addition, a controller configured to control the air conditioner to decrease an amount of air flow in response to determining that no person or moving object is detected.

DETAILED DESCRIPTION

Figure 1:
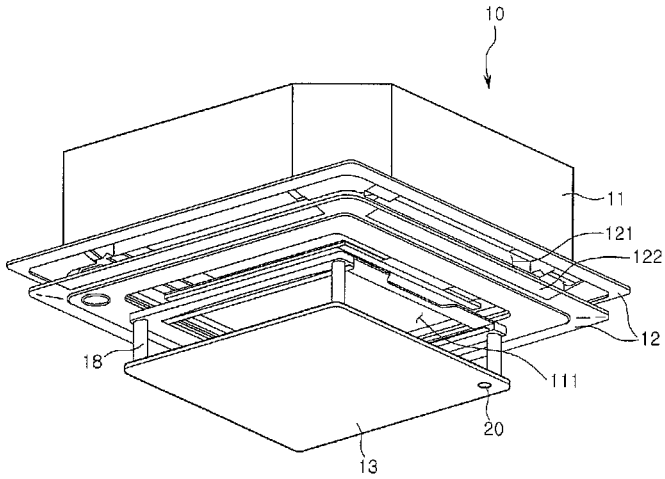
FIG. 1 is a perspective view of a ceiling type air conditioner.
Figure 2:
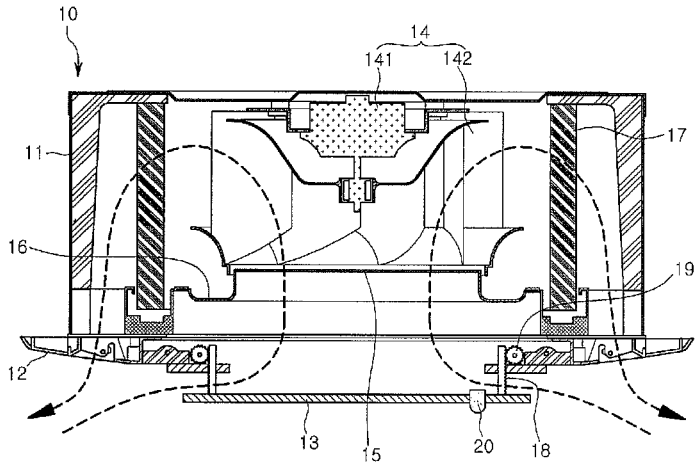
FIG. 2 is a longitudinal cross-sectional view schematically showing an inner configuration of the air conditioner in FIG. 1.

Referring to FIGS. 1 and 2, a ceiling type air conditioner having an indoor unit 10 includes a cabinet 11 that defines an external appearance, a front panel 12 that is coupled to a lower end of the cabinet 11, a suction panel 13 that is elevatably coupled to the front panel 12, a heat exchanger 17 that is enclosed around an inner side of the cabinet 11, a fan assembly 14 that is positioned in an inner side space of the heat exchanger 17, a shroud 16 that is positioned at a lower side of the fan assembly 14 to guide a flow of the sucked air, a filter 15 that is positioned on an upper end of the shroud 16 to purify the sucked air; and a sensor unit 20 that is mounted on one side of the suction panel 13 to detect a position and movement of indoor residents. The sensor unit 20 may be an Infra-Red sensor using infrared rays.

In detail, an edge part of the front panel 12 is connected with four outlets 121. Each outlet 121 has a discharge vane 30 that is rotatable. And, the direction of air is controlled based on the rotation angle of the discharge vane. When a position of a indoor resident is detected by the sensor unit 20, the rotation angle of the discharge vane 30 is controlled by a controller to provide air to the resident.

In addition, the central part of the front panel 12 has an inlet 111 for sucking the indoor air and the inlet 111 is selectively shielded by the suction panel 13. A plurality of racks 18 are extended to the upper surface of the suction panel 13. A pinion 19 that is positioned on a upperside of the front panel 12 is coupled to the rack 18 and a driving motor. The pinion 19 is rotated by driving the driving motor. Therefore, the suction panel 13 can move a predetermined distance between the upper and lower positions by the operations of the rack 18 and pinion 19. And, the inlet 111 is selectively opened and closed by the movement of the suction panel 13. It is to be noted that the moving unit of the suction panel 13 is not limited to the foregoing rack/pinion structure.

In addition, air that includes foreign materials sucked through the inlet 111 are filtered by passing through the filter 15 and the filtered air is sucked toward the fan assembly 14. The fan assembly 14 includes a centrifugal fan 142 and a fan motor 141 for driving the centrifugal fan 142. The centrifugal fan 142 is configured to direct a air flow from a suction part of the air conditioner to radical discharge part of the air conditioner as shown in FIG.2. The air sucked by the fan assembly 14 passes through the heat exchanger 17 and is then provided to the room through the outlet 121.

In some examples, the sensor unit 20 is mounted on the suction panel 13 and its mount position may be mounted on one side edge of the suction panel 13 as shown in FIG. 1 and FIG. 2. Alternatively, the sensor unit 20 may be mounted at the central part of the suction panel 13.

If a sensor unit 20 is mounted on the one side of the front panel 12, the suction panel 13 can serve as an obstacle because the suction panel 13 is located at the lower position. For instance, the infrared rays sent from the sensor unit 20 impinge on the suction panel 13, such that the sensor unit 20 cannot detect a position of a resident in a room. However, if the sensor unit 20 is mounted on the suction panel 13, the above obstacle may be reduced. As a result, the phenomenon of limiting the sensing range due to moving the suction panel 13 may be reduced.

Further, as radiating infrared rays are received by a sensing element that is positioned inside the sensor unit 20, the sensing element of the sensor unit 20 can be rotated 360° by a driving unit. The configuration and operation of the sensor unit 20 will be described below with reference to FIGS. 3 and 4.

Figure 3:
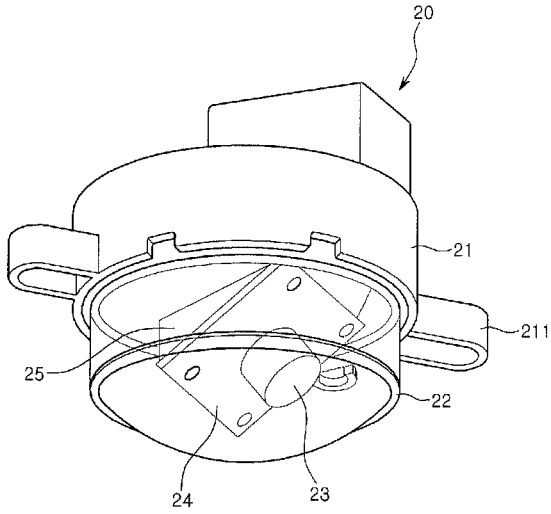
FIG. 3 is an external appearance perspective view of a sensor unit.
Figure 4:
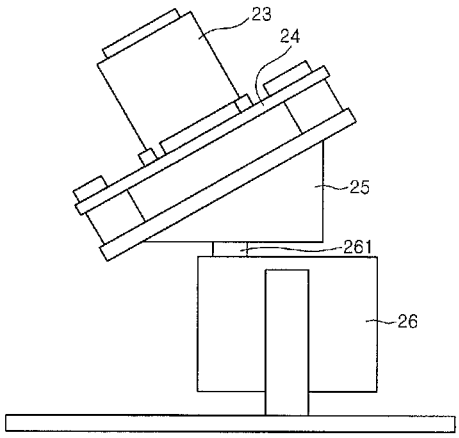
FIG. 4 is a side view showing a configuration of a detecting unit.

Referring to FIGS. 3 and 4, the sensor unit 20 includes a case 21 connecting a part of the detecting unit shown in FIG. 4 and a sensor cover 22 coupled to the lower end of the case 21. A bracket 211 is extended to the outer circumferential surface of the case 21 and the bracket 211 is fixed to the upper surface of the suction panel 13 by a connection member. The sensor cover 22 is defined in a cylindrical shape and its bottom surface has a convexly curved shape, having a predetermined curvature. The bottom surface of the sensor cover 22 is convexly curved, such that the refraction of the signal radiated from the detecting unit is minimized. The sensor cover 22 can be made of opaque materials and has a thickness that can easily transmit the infrared signal radiated from the detecting unit. For example, the sensor cover 22 is made of opaque materials, such that the indoor resident does not misunderstand the sensor as a surveillance camera. Although that, as explained, the sensor can transmit most infrared signals to easily detect the indoor resident. Only the convex bottom part of the sensor cover 22 may be exposed to the indoor.

The detecting unit includes a sensing element 23 that radiates the sensing signals such as infrared rays, a circuit board 24 coupled to the sensing element 23 and has circuits for the operation of the sensor unit mounted thereon, a supporter 25 that supports the circuit board 24, and a driving motor 26 that is connected to the lower side of the supporter 25 to rotate the supporter 25.

In addition, the rotation shaft 261 of the driving motor 26 is connected to the lower end of the supporter 25. The upper surface of the supporter 25 is connected to the circuit board 24 and configured to be inclined at a predetermined angle as shown FIG. 4. Therefore, the sensing element 23 can rotate 360° at the state inclined at a predetermined angle from a vertical line, such that the sensing range is extended. The sensing element 23 is mounted to be inclined from a vertical line, such that the bottom surface of the sensor cover 22 is defined in a convexly curved shape, thereby making it possible to minimize the refraction phenomenon of the infrared signals radiated from the sensing element 23. For example, the infrared rays radiated from the sensing element 23 are orthogonal to a tangential line that passes through the bottom surface of the sensor cover 22 corresponding to a point through which the infrared rays pass, such that the signals radiated from the sensing element 23 can effectively transmit the sensor cover 22.

The driving motor 26 may be a step motor that can rotate forward or reversely and the sensing element 23 also rotates 360° forward and then rotates 360° reversely by the forward/reverse rotation of the driving motor 26.

If an operation instruction from the indoor unit 10 is provided to the sensor unit 20, the driving motor 26 can rotate in a forward direction and then rotate in a reverse direction at a predetermined time interval. For example, the driving motor rotates in a forward direction at a predetermined speed and then rotates in a reverse rotation at the same speed. The driving motor performs the forward direction and the reverse rotation again after the predetermined time elapses. The sensing signal is transmitted from the sensing element 23 and returned to the sensing element reflected by the residents, thereby detecting the position of the residents in the indoor, room or space. The sensing element 23 can detect the position or movement of the resident as well as detect heat radiated from the resident, making it possible to detect the state of the resident by the controller. For example, in the heating mode, if the heat radiated from the resident is lower than a reference value stored in the memory of the controller, it is determined that the resident feels a chill, thereby making it possible to control the rotation angle of the discharge vane 30 to provide heated air to the resident. The sensing element 23 may start detecting a position of the resident after the movement of suction panel 13 is completed. When the air conditioner is turned on or activated from a sleeping state, the suction panel 13 moves toward a lower position from the ceiling. After the movement of the suction panel 13 is completed or almost completed, an instruction signal is sent to the sensing unit 24 from the indoor unit 10 and then the driving motor 26 drives the sensing element 23 to search a position of the resident in the room. The sensing element 23 then sends an infrared signal and receives the infrared signal reflected by the person in the room. Based on the movement of sensing element 24, for example rotating forward or reverse, the sensing unit 23 can detect any object or person currently in the room. The sensing element 23 is located in the lowest position from the bottom of the room, there is no obstacle when the sensing element 23 sends and receives the infrared signal to detect the person in the room. In this implementation, in a sleeping mode, an activating temperature of the air conditioner to activate the air conditioner based on the setting temperature is adjusted to higher than an activating temperature of the air conditioner that user sets. For example, the activating temperature of the air conditioner is adjusted three degree up comparing to a current a activating temperature of the air conditioner.

As another example, the sensing element 23 may start a sensing operation earlier than the above implementation. For example, the sensing element starts detecting an object in response to power on signal of the air conditioner. When the air conditioner is turned on or activated from a sleeping state, the suction panel 13 moves toward a lower position from the ceiling. While the suction panel is moving, the sensing unit 24 carries out the search operation in response to an instruction signal from the controller of the air conditioner. Therefore, a cool air generated by the air conditioner can be supplied to the resident as soon as the operation of the air conditioner begins.

In addition, the sensing unit 20 can control the air conditioner in response to detecting a moving object or person in the room. In this implementation, the sensing element 23 can search an object or a person in the room periodically for example, every one minute while the air conditioner is turned off. The sensing element 23 may have a separate power source such as a battery or may have a different power line from the air conditioner for this operation. If a person comes into the room while the air conditioner turns off, the sensing unit 20 can detect a position of the person in response to receiving the sensing signal, and then sends a command to the air conditioner. In response to the command, the air conditioner turns on, the suction panel moves down from ceiling, and air passes through the inlet 111, a heat exchange 17 and a discharge vane 30 sequentially. Therefore, a cool air can be supplied to the person in response to detection the position of the person in the room. Alternatively, the command can be generated in the controller of the air conditioner. In this case, the controller has a power source.

Furthermore, if the sensing element can not detect a person for a predetermined time, another control signal is provided to the air conditioner. For example, when the person leaves the room, the sensing element 23 can not detect any moving object any more. If the sensing element 23 can not detect any object or person for a predetermined time such as five minutes, the sensor unit 20 sends an another command to the air conditioner. The air conditioner is then turned off or decreases an amount of the cool air in response to the command signal. Those operations are controlled by the controller of the air conditioner. Another implementation is that, in response to the command signal, the air conditioner decreases the amount of the cool air for a predetermined time, for example thirty minutes, and then turns off. In this implementation, instead of power off, the air conditioner may be set to the sleeping mode. For example, an activating temperature may be changed three degree higher than an activating temperature that the air conditioner currently is set.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An air conditioner comprising:

a cabinet configured to mount on an indoor ceiling;

a front panel coupled to the cabinet and having an air inlet and outlet;

a suction panel coupled to the front panel and configured to move between an open position in which air is able to circulate through the air conditioner and a closed position in which air is blocked from circulating through the air conditioner;

a sensor unit that is mounted on the suction panel, that is configured to move together with the suction panel and that is configured to detect a position of a person in the indoor place; and a controller configured to adjust a direction of air flow from the outlet based on the detected position of the person.

2. The air conditioner of claim 1, wherein the sensor unit is mounted on an edge part of the suction panel.

3. The air conditioner of claim 1, wherein the sensor unit is mounted on a central part of the suction panel.

4. The air conditioner of claim 1, wherein the sensor unit comprises:

a sensing element configured to rotate forward or reversely in response to a driving signal generated by a driving motor; and a sensor cover configured to cover the sensing element.

5. The air conditioner of claim 4, wherein the sensor cover is defined in a cylindrical shape or its bottom part has a convexly curved shape.

6. The air conditioner of claim 4, wherein the sensor cover is defined as an opaque body or material.

7. The air conditioner of claim 1, wherein the sensor unit further detects movement of the person in the indoor.

8. The air conditioner of claim 1, wherein the sensor unit further detects heat radiated from the person and generates a control signal to control a temperature of air output by the air conditioner based on comparing the detected the radiant heat with a reference value.

9. The air conditioner of claim 1, wherein an amount of rotation of a discharge vane is adjusted by the controller.

10. An air conditioner comprising:

a cabinet configured to mount on an indoor ceiling;

a front panel coupled to the cabinet;

a suction panel coupled to the front panel and configured to move between an open position in which air is able to circulate through the air conditioner and a closed position in which air is blocked from circulating through the air conditioner;

a sensor unit mounted on the suction panel configured to move together with the suction panel, configured to detect a position of a person and configured to start the detection in connection with movement of the suction panel during an initial stage of the air conditioner; and a controller configured to adjust a direction of air flow from the outlet based on the detected position of the person.

11. The air conditioner of claim 10, wherein the sensor unit comprises:

a sensing element configured to rotate forward or reversely in response to a driving signal generated by a driving motor; and a sensor cover configured to cover the sensing element.

12. The air conditioner of claim 11, wherein the sensor cover is defined in a cylindrical shape or its bottom part has a convexly curved shape.

13. The air conditioner of claim 11, wherein the sensor cover is defined as an opaque body or material.

14. The air conditioner of claim 10, wherein the sensor unit is configured to start the detection after the movement of the suction panel is completed.

* * * * *